US008192292B2

(12) United States Patent
Popielarz et al.

(10) Patent No.: US 8,192,292 B2
(45) Date of Patent: Jun. 5, 2012

(54) AUTOMATED BOWLING SYSTEM, CONTROLLER AND METHOD OF USE

(75) Inventors: Matthew E. Popielarz, Aylett, VA (US); LeRoy T. Warren, Jr., Richmond, VA (US); Samuel R. Namala, Mechanicsville, VA (US); Edward C. Hibbard, Jr., Mechanicsville, VA (US)

(73) Assignee: Quibicamp Worldwide LLC, Mechanicsville, VA (US)

( * ) Notice: Subject to any disclaimer, the term of this patent is extended or adjusted under 35 U.S.C. 154(b) by 2113 days.

(21) Appl. No.: 11/159,273

(22) Filed: Jun. 23, 2005

(65) Prior Publication Data

US 2005/0288115 A1 Dec. 29, 2005

Related U.S. Application Data

(60) Provisional application No. 60/582,026, filed on Jun. 23, 2004.

(51) Int. Cl.
*A63D 5/06* (2006.01)

(52) U.S. Cl. ..... 473/102; 473/54; 473/101

(58) Field of Classification Search ..... 473/54–106; 463/1–6

See application file for complete search history.

(56) References Cited

U.S. PATENT DOCUMENTS

| | | | | |
|---|---|---|---|---|
| 3,193,290 | A | 7/1965 | Dowd et al. | |
| 5,101,354 | A | 3/1992 | Mowers et al. | |
| 5,429,554 | A * | 7/1995 | Burkholder | 473/73 |
| 5,437,576 | A * | 8/1995 | Tuten et al. | 473/65 |
| 5,803,819 | A * | 9/1998 | Tuten et al. | 473/65 |
| 6,129,636 | A * | 10/2000 | Tuten et al. | 473/102 |

* cited by examiner

*Primary Examiner* — Ronald Laneau
*Assistant Examiner* — Ross Williams
(74) *Attorney, Agent, or Firm* — Andrew M. Calderon; Roberts Mlotkowski Safran & Cole, P.C.

(57) ABSTRACT

A bowling system comprises a pinspotter system including at least a sweep assembly and a braking system coupled thereto which provides a brake for the sweep assembly. The system further includes a plurality of sensors which sense parameters associated with the pinspotter system and the braking system. A centralized control system centralizes operational processes of the pinspotter system by receiving at least one input based on the sensed parameters from at least one of plurality of sensors and, in response to the at least one the input, produces at least one output signal to control operations of the pinspotter system.

39 Claims, 15 Drawing Sheets

AUTOMATED BOWLING SYSTEM, CONTROLLER AND METHOD OF USE

CROSS REFERENCE TO RELATED APPLICATION

This application claims priority to U.S. provisional application Ser. No. 60/582,026, filed on Jun. 23, 2004, which is incorporated herein by reference.

FIELD OF THE INVENTION

The invention is directed to an automated bowling system, controller and method of use, and more particularly to an automatic pinspotter system with related mechanisms and a control which centralizes processing and commands, and incorporates self-adjusting features and improved safety.

DISCUSSION BACKGROUND DESCRIPTION

Many different models of automatic pinspotting machines, i.e., pinspotters, are in use in bowling centers throughout the world today, several of which have been produced by AMF, namely the 82-30, 82-70, 82-90, and 8800 Gold models. The first commercially available pinspotter was the model 82-30, produced in 1952. Over the years, though, as technological advances have been made in the areas of electronics, metal working, and plastics, progressive models of pinspotters have been developed. A parallel contributor to the need of new designs has been an increased demand in functionality as the sport of bowling has evolved over the years.

Many pinspotters and bowling lane systems include a control chassis. These control chassis provide the intelligence required for operation; however, these chassis are not directly linked to all of the subassemblies of the bowling system such as, for example, the foul line detector. In these instances, some of the subassemblies include their own logic, which is merely transferred to the chassis or other components. This adds to the complexity of the system from both an installation and maintenance standpoint.

Each pinspotter employs three motors, all of which must be powered on and off at precise moments for the machine to perform properly. Also within a pinspotter is a plurality of cam based switches which control the movements of the machine and provide information to the chassis to direct its control of the motors. The three motors are the Back End motor, Sweep Drive motor, and Table Drive motor. Functions such as lifting bowling pins, distributing bowling pins to their proper waiting locations, separating a delivered bowling ball from the bowling pins, and returning the bowling ball to an awaiting bowler are handled by the Back End motor. The Sweep Drive motor, on the other hand, causes motion to the Sweep Linkage (gate) which is responsible for pushing fallen pins into the pit area of the pinspotter. The Table Drive motor operates the Table mechanism which sets the pins on the lane surface.

Early control chassis were large and heavy, and each pinspotter required its own chassis. Also, numerous electrical connections had to be made within the machine. The early pinspotters were not designed for modularity, making troubleshooting and repair difficult and time-consuming tasks.

In the early 1990's, AMF developed a state-of-the-art control chassis called the XL Chassis. In this design, one chassis controlled two pinspotters. The XL Chassis was considerably less bulky than the earlier chassis and highly modular. Individual wires with solder connections and terminal blocks were replaced with cable harnesses which used locking plug-style connectors. As an added component, the Front End Box handled some of the processing for the XL Chassis and provided push button machine controls at the front of the pinspotter. Functions such as ball detection, foul detection, ball lift control, and pinspotter reset switch were handled by the Front End Box and communicated to the Chassis. However, there were only limited functions available with this Chassis. Another added feature was a communication link between pinspotter chassis from one pair of pinspotters to another. This network of chassis was then controlled by the Manager's Control Unit located at the Front Desk of the bowling center. Individual or groups of pinspotters could now be tasked by front desk personnel.

Although much was accomplished in redesigning the control chassis of the pinspotter, nothing has been done to date to improve the feedback given to the chassis from the pinspotter. The same switches and cams used to coordinate the motions of the Pin Table and Sweep subassemblies within the pinspotter remained unchanged. With no means for this new chassis to communicate its functions/errors to an operator via digital display or LCD, diagnostics were limited to several LEDs which lit to show open/close status of the pinspotter's switches. Also the cams and switches were in regular need of adjustment and maintenance by the operator. Demands from the market for increased reliability, decreased maintenance, and user-friendliness have created a need for a more advanced control system for the automatic pinspotter.

SUMMARY OF THE INVENTION

In a first aspect of the invention, a bowling system comprises a pinspotter system including at least a sweep assembly and a braking system coupled thereto which provides a brake for the sweep assembly. The system further includes a plurality of sensors which sense parameters associated with the pinspotter system and the braking system. A centralized control system centralizes operational processes of the pinspotter system by receiving at least one input based on the sensed parameters from at least one of the plurality of sensors and, in response to the input, produces at least one output signal to control operations of the pinspotter system.

In another aspect of the invention, a bowling system comprises one or more bowling lanes and a centralized control system centralizing operational processes of the one or more bowling lanes by receiving at least one input based on sensed parameters from a plurality of sensors coupled to the centralized control system. The centralized control system monitors, controls and provides diagnostics for one or more bowling lanes.

In another aspect of the invention, a bowling system comprises a home sensor comprising a home photodiode and a disk having a slot mounted on an assembly shaft. An alignment of the slot with a beam emitted from the home photodiode represents an angled position of the assembly shaft or a home position of an assembly. A position sensor comprises a position photodiode and a position disk having a plurality of slots or holes located about a circumference of the position disk. The position disk is mounted to a motor shaft of the assembly. A beam emitted from the position photodiode is interrupted as the motor shaft rotates. A centralized controller is coupled to the home sensor and the position sensor. The centralized controller stores a home position of the assembly as a reference and based on the reference, and a number of interruptions sensed by the position sensor, calculates a position of the assembly.

In another aspect of the invention, a bowling system comprises a centralized control system centralizing operational processes of assemblies of the bowling system by receiving inputs based on the sensed parameters from at least one sensor and, in response thereto, provides control, diagnostics and monitoring of operations of the bowling system via an LCD display, either coupled directly to or remote from the centralized control system.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention is directed to, for example, an automated bowling system, method of use and controller. In a more detailed embodiment, the invention is related to an automatic pinspotter system and method of use and a controller which centralizes processing and commands thereof with further operations. In one aspect of the invention, the controller controls the coordinated movements of a pin table and sweep subassemblies of a pinspotter or pinspotters with a greatly improved degree of accuracy and safety. In addition, the controller includes functionalities and displays which greatly facilitate adjustments of the systems, as well as providing and displaying such information to the technician such as, for example, diagnostic information, status information or system setting information.

Overview of System of Invention

Figure 1:
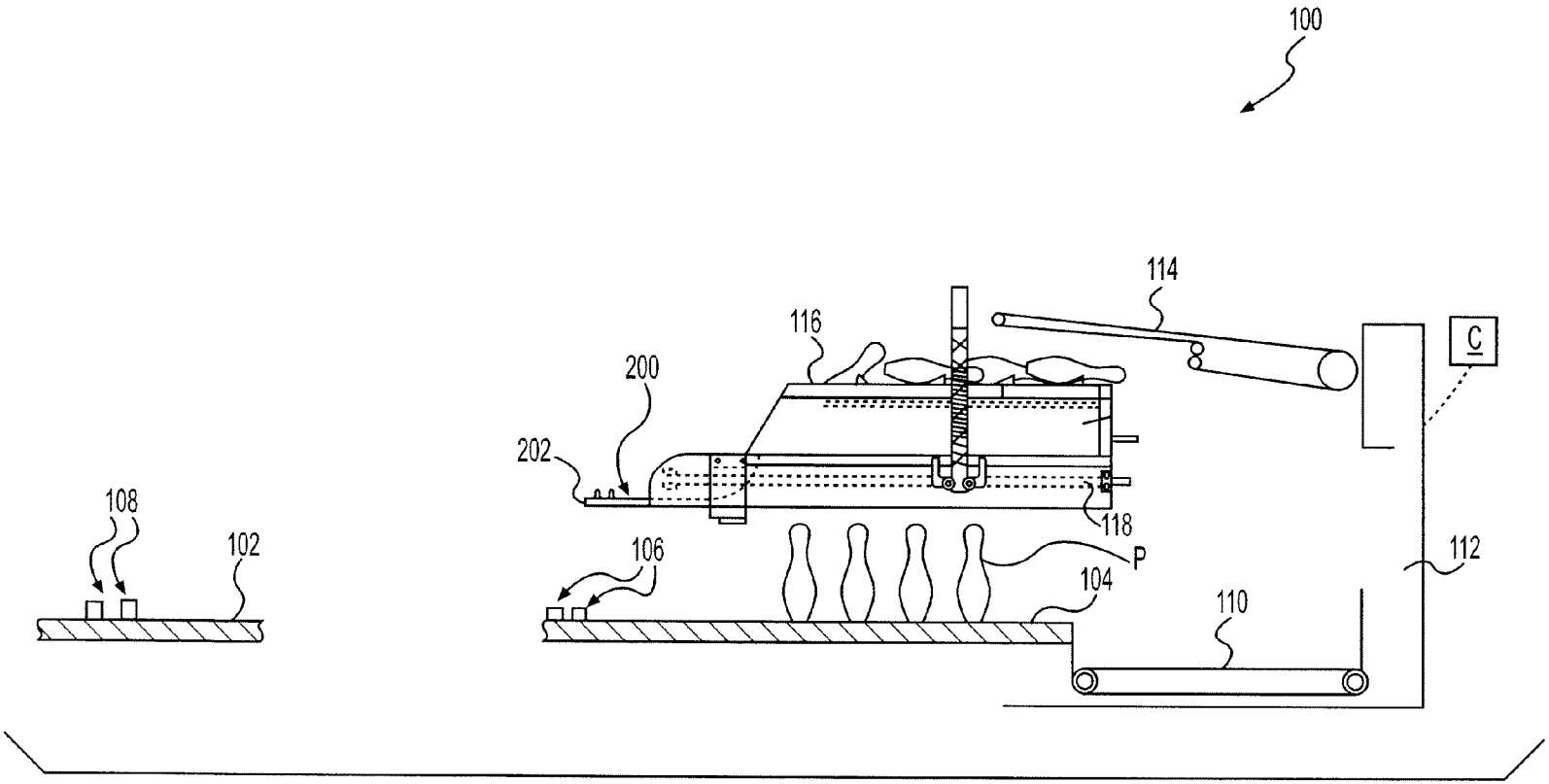
FIG. 1 shows an overall diagram of the bowling system in a home position, in accordance with an aspect of the invention.

FIG. 1 shows an overview of the system, in a home state. The system is shown generally as reference numeral 100 and includes a bowling lane 102, terminating at a pin deck 104. A plurality of pins "P" are arranged on the pin deck 104 in a known arrangement. The system 100 further includes a first sensor 106 which senses a speed of a bowling ball and provides several safety features, as well as a second sensor 108 which acts as a mechanism for foul line violations. The first and second sensors 106, 108 are, in one aspect of the invention, photodiodes well known in the art, in communication with a controller "C". In use, for example, upon breaking a beam or beams, the sensors 106, 108 can be used to calculate and/or determine ball speed and foul line violations, as described more fully below.

The system 100 further includes a controller "C" for controlling the several subcomponents or subassemblies of the system from, for example, transporting and placing the pins "P" in the prearranged order to a clearing of the pin deck 104, to mention a few. One such subassembly is generally referred to as a pinspotter mechanism which may include, for example, a sweep or rake assembly 200 having a gate 202, as well as a pit transport carpet 110 which transports the pins "P" to a pin elevator 112 for delivery to a pin bin 116 via a distributor 114.

The distributor 114, in one embodiment of the invention, is a belt transport which is moveable by an arm assembly (not shown) for placing the pins "P" in appropriate placement holders within a pin bin 116. The pins "P" located and arranged in the pin bin 116 are supplied to a pin setting device or table 118 for future placement on the pin deck 104. The pin table 118 also captures and lifts any pins "P" remaining in a standing position on the pin deck 104 after a bowling ball is thrown down the lane.

Figure 2:
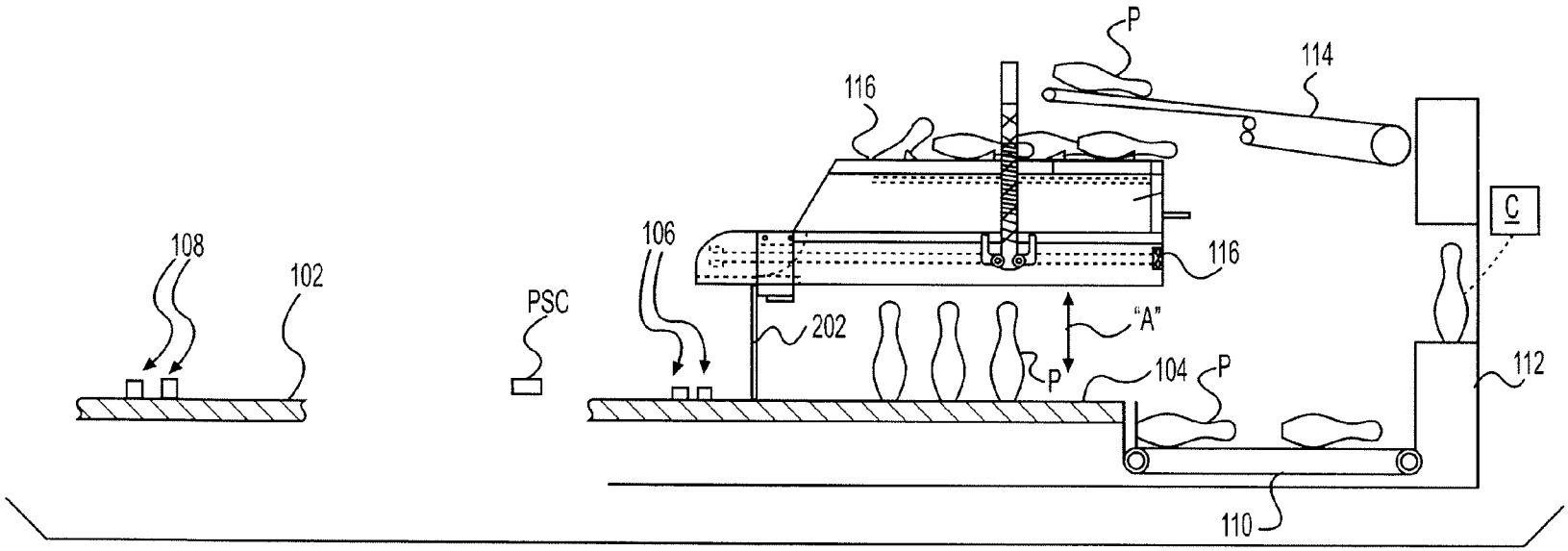
FIG. 2 shows an overall diagram of the bowling system in a down ($1^{st}$ guard) position, in accordance with the invention.
Figure 3:
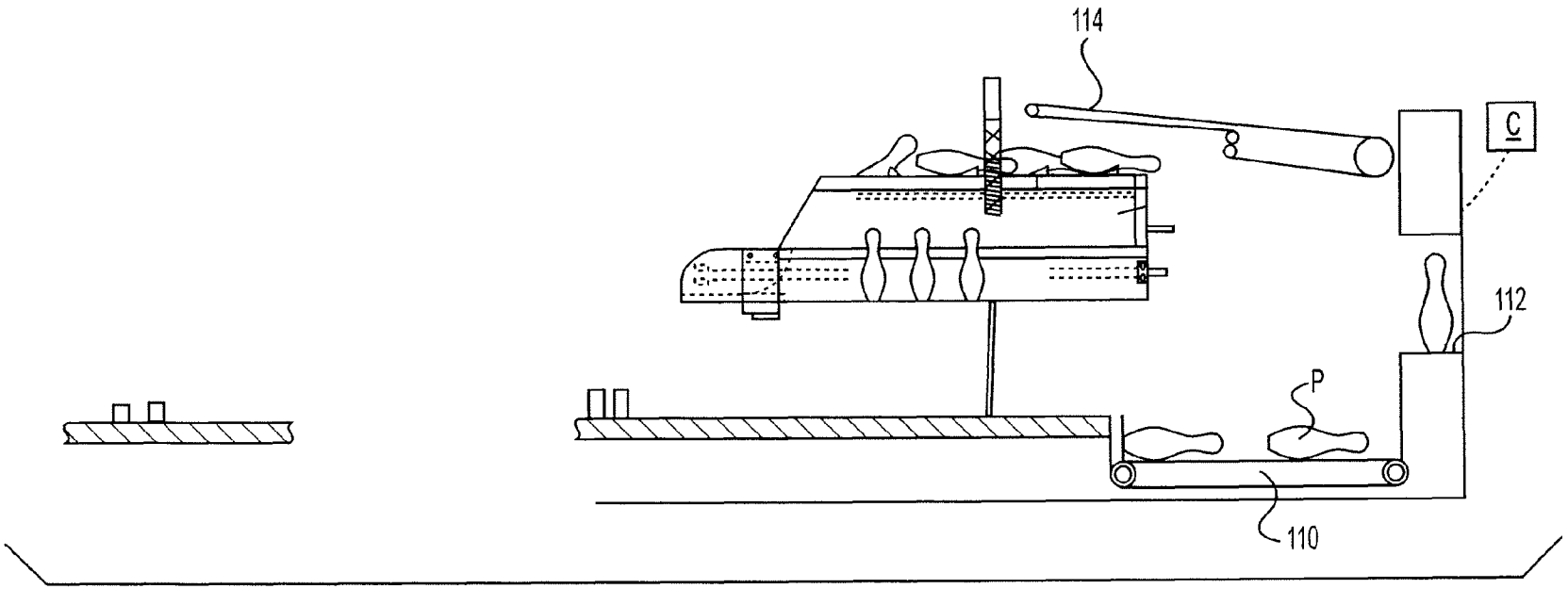
FIG. 3 shows an overall diagram of the bowling system in a sweep position, in accordance with an aspect of the invention.

FIGS. 2 and 3 represent two stages of operation in accordance with the invention. In the operational stage of FIG. 2, for example, a bowling ball passes through beams of the sensor 106, which starts drive motors for the pin setting equipment. In particular, after the ball passes through the beams the gate 202 will be lowered. This will protect the subassemblies from damage in case other bowling balls or objects are thrown down the lane during the clearing stage. Additionally, in this operational stage, for example, the pin table 118 will be lowered to capture the remaining standing pins and then raised with such pins in order to clear the pin deck 104 prior to a sweep, as represented by arrow "A".

During this operational stage, the gate can also be used to trigger a camera "PSC" (FIG. 2). The PSC can be a digital camera which captures the standing pins and relays this information to the controller "C". In one preferred embodiment, three pictures are captured for the controller "C". The controller "C" can then interpret this information in order to provide a count of the fallen pins "P" for scoring or other known purposes. This information may also be used to determine whether the sweep has to be activated when a gutter ball was thrown, e.g., no pins were struck and all pins remain standing.

In the operational stage shown in FIG. 3, for example, the pin table 118 is positioned in the raised position and the gate will sweep or clear the fallen pins from the pin deck 104 and gutter area. The fallen pins "P" will then be transported, via a sweeping action of the gate 202, to the pit transport carpet 110 which transports the pins "P" to a pin elevator 112 for delivery to the pin distributor 114. The pins "P" will then be loaded into the appropriate placement holders within the pin bin 116. These functions, amongst others, are controlled and coordinated by the controller "C".

Figure 4:
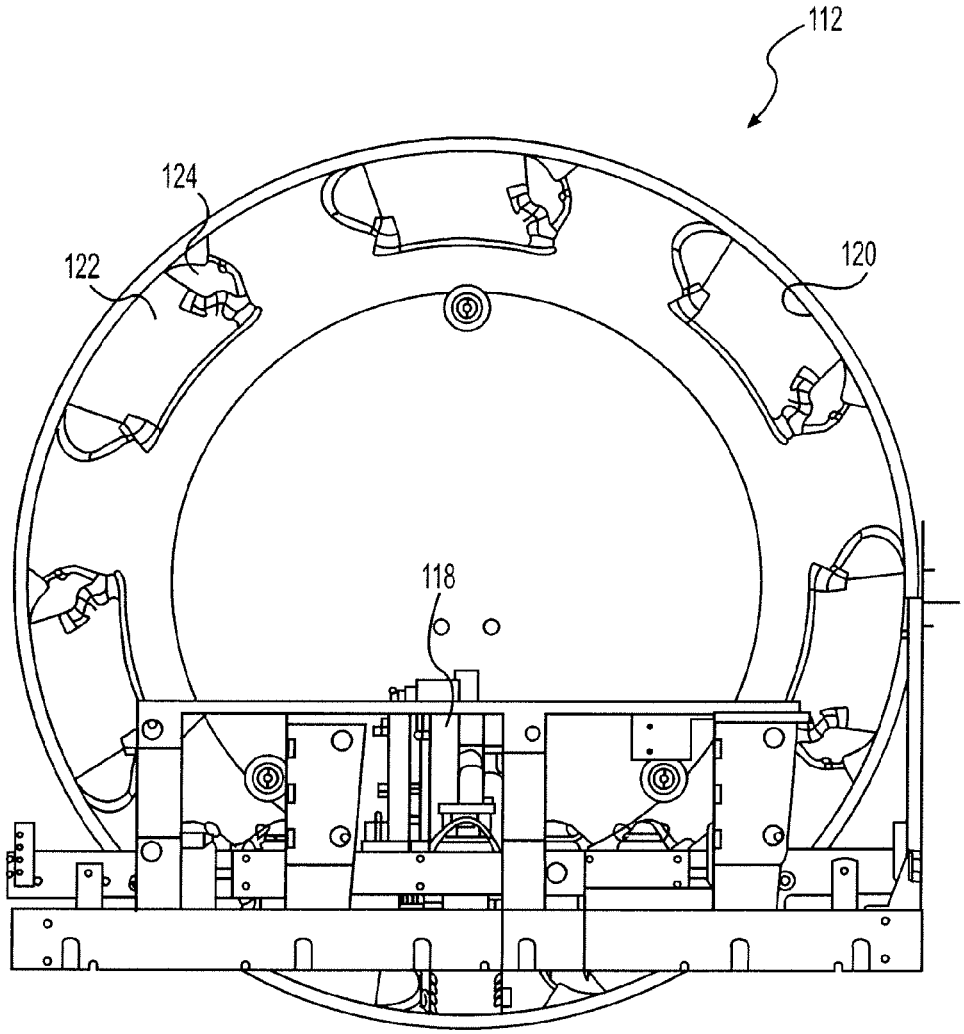
FIG. 4 shows a front view of one type of pin elevator capable of being used with the invention.

FIG. 4 shows a front view of one pin elevator capable of being used with the invention. The pin elevator 112 is a rotating wheel that includes any well known motor assembly (not shown) such as, for example, a chain or belt driven motor, to rotate the pin elevator about 360°. In an alternative example, the pin elevator is seated on support rollers connected by way of a synchronous gear and a worm gear to a driving motor (not shown).

The pockets 120 of the pin elevator receive the pins "P" and transfers the pins "P" in a lifting motion from the pit area to the distributor 114. The distributor 114 then swings to a respective position located on the pin bin 116.

Figure 5:
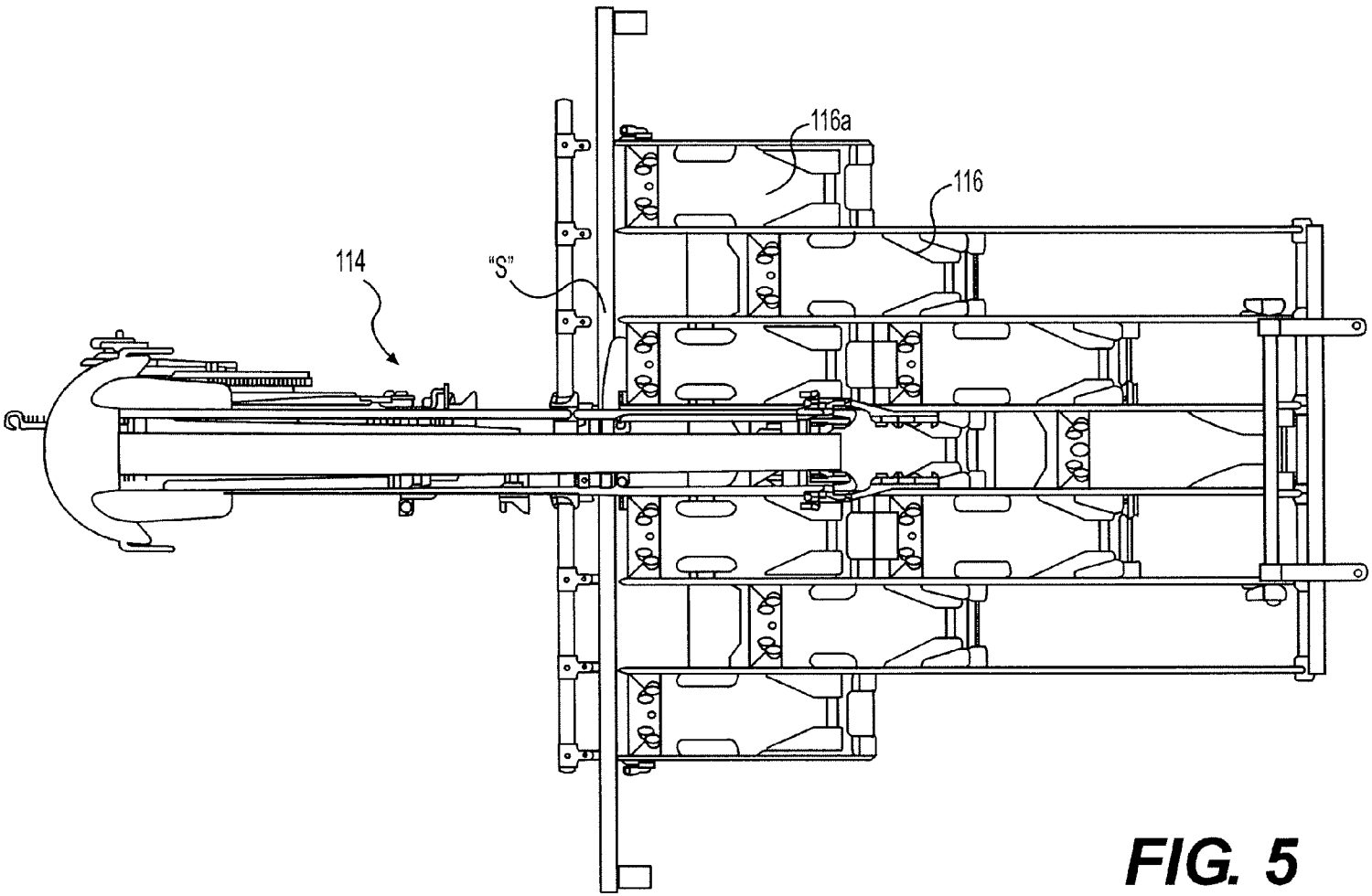
FIG. 5 shows a top view of one type of pin distributor capable of being used with the invention.

FIG. 5 shows a top view of a pin bin 116 capable of being used with the invention. The pin bin is well known in the art and only a general description is required herein for one of ordinary skill in the art to understand its functions within a bowling system. The pin bin 116 includes 10 pin locations 116*a*, corresponding to the locations of the pin placement on the pin deck 104. The pin bin 116 includes a bin switch or sensor "8" such as, for example, a position sensor, to determine whether a pin "P" has been placed in the last placement location. The activation of the sensor "s" is used to signify that all of the pins "P" are available for the table 118 to set a new rack of pins. In one embodiment, the last placement location is the #9 pin location.

Pinspotter

Figure 6:
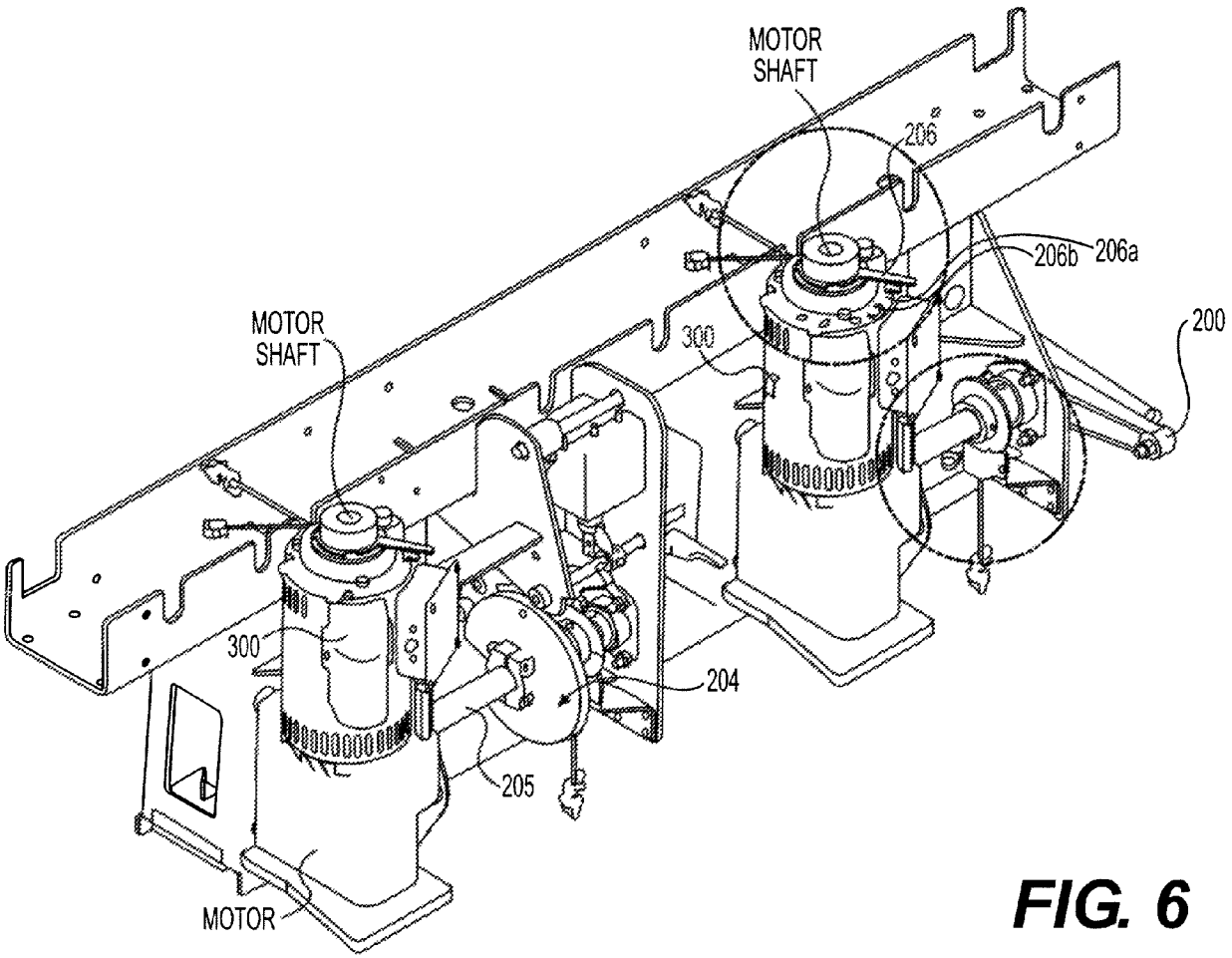
FIG. 6 shows a view of the position control system of the pinspotter in accordance with an aspect of the invention.
Figure 6B:
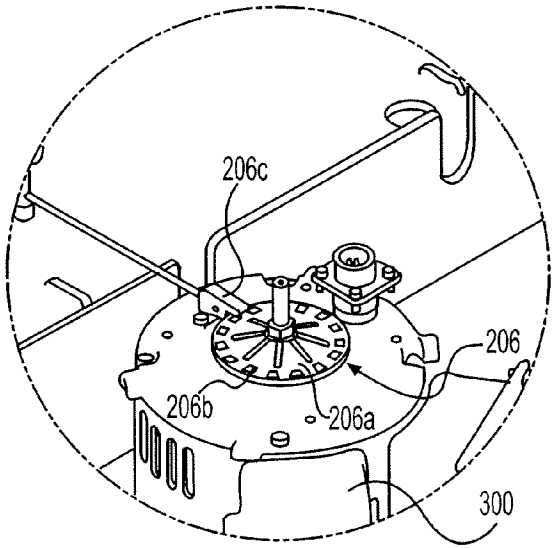
FIG. 6B shows a view of the position control system including detail of the position sensor of the pinspotter in accordance with an aspect of the invention.
Figure 6A:
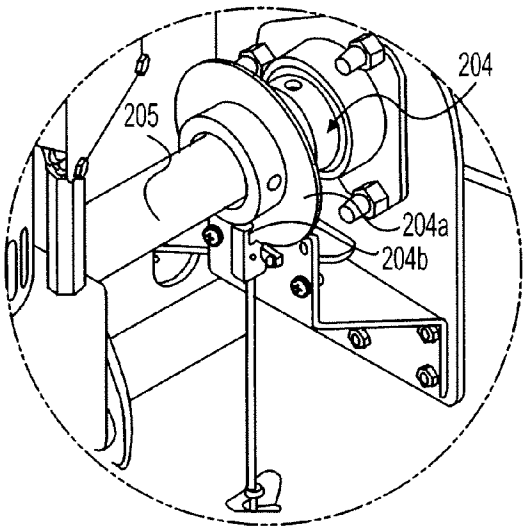
FIG. 6A shows a view of the position control system including detail of the home sensor of the pinspotter in accordance with an aspect of the invention.

The pinspotter includes several interrelated subcomponents controlled by the controller "C". Referring to FIG. 6, the pinspotter of the invention, in accordance with one aspect, is a cam-less system; that is, there are no cams or switches to control and position the sweep or rake assembly 200 and pin table 118 subassemblies. Instead, a position control system comprising a home sensor 204 (FIG. 6A and FIG. 7) and position sensor 206 (FIG. 6B) is utilized by the system of the invention. The home sensor 204 and position sensor 206 are non-contact sensors which, in use, considerably reduce the number of adjustments necessary to coordinate the motions of the pin table and sweep or raking system 200 within a pinspotter or pinspotters both during initial installation and during regular operation.

Figure 7:
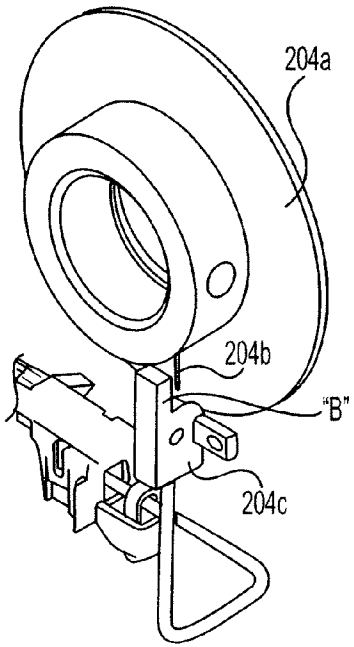
FIG. 7 shows an exploded view of the home sensor in accordance with an aspect of the invention.

Referring to FIGS. 6 and 7, in one embodiment, the home sensor 204 (FIG. 6A and FIG. 7) includes a disk 204*a* having a slot 204*b* mounted to a shaft 205. The shaft 205 is used to position and move the sweep or raking system 200, e.g., gate 202, and the pin table 118, via motors "Motor" (FIG. 6), through the operational stages shown in FIGS. 1-3, for example. The sensor 204 further includes a photodiode 204*c* having an emitter and detector or reflector adjacent opposing sides of the disk 204*a*. FIG. 7 shows an exploded view of the home sensor 204.

The alignment of the slot 204*b* with a beam "B" (FIG. 7) emitted from the photodiode 204*c* represents a home position of the sweep or rake assembly 200, e.g., gate 202, and the pin table 118 as shown in FIG. 1. That is, when the beam "B" of light passes through the slot 204*b* (FIG. 6), the gate 202 and the pin table 118 are known or adjusted to be both in the upper or retracted position of FIG. 1. This home position is represented by a 0° angle of the shaft and can be used as a reference to (i) adjust the positions of the sweep or rake assembly 200, e.g., gate 202, and the pin table 118 and (ii) determine the relative positions of the sweep or rake assembly 200 and the pin table 118 throughout any of the stages shown in FIGS. 1-3. In the latter situation (ii), the home position can thus be used as a starting reference point by the controller "C" to instruction movement of the sweep or rake assembly 200 and the pin table 118 throughout the stages shown in FIGS. 1-3.

The use of the home sensor 204 also considerably reduces the time required for adjusting the stages of the pinspotter. For example, by simply aligning the slot 204*b* with the beam "B" of light emitted by the photodiode 204*c*, the technician will be able to easily adjust the shaft to the 0° angle or home position. Additionally, the disk 204*a* can also be adjusted to align the slot 204*b* with the emitted beam "B" when the technician has determined that the gate and pin table are properly retracted; despite the controller "C" indicating that the shaft angle is at 0°. The controller "C" will store this positional information in memory for automatic adjustment and relative positioning of the remaining stages of the sweep or rake assembly 200 and the pin table 118.

The position sensor 206 (FIG. 6B), on the other hand, is preferably mounted on the motor shaft of the pin table 118 and the sweep or rake assembly 200. However, it should be realized by those of ordinary skill in the art that one position sensor 206 may, instead, be mounted to the shaft 205; although, the accuracy of the system may be impaired since one rotation of the shaft 205 would represent an entire cycle of the system as shown in FIGS. 1-3, for example.

Figure 8:
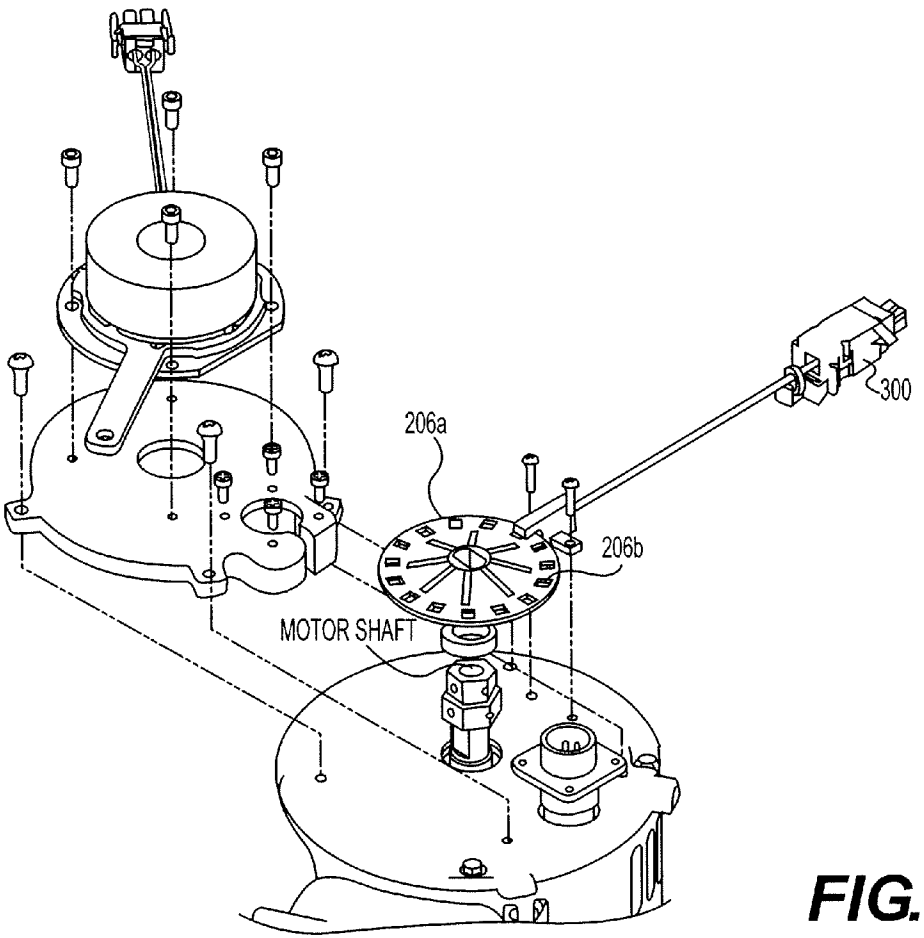
FIG. 8 shows an exploded view of the position sensor in accordance with an aspect of the invention.

Referring now to FIGS. 6 and 8, in one embodiment, the position sensor 206 (FIG. 6B) comprises a disk 206*a* having approximately 15 slots or holes 206*b* located about a circumference, and a photodiode 206*c* adjacent opposing sides of the disk 206*a*. The use of 15 slots is preferable since this configuration provides a common denominator for a 50 hertz and 60 hertz system with a gear ratio of 120:1 and 144:1, respectively, to obtain a same speed. By way of example, a count of 120×15 may be used for a 50 hertz system and a count of 144×15 may be used for a 60 hertz system. It should be understood, though, that the disk can have any number of slots or holes therein, depending on the desired accuracy of the system; however, a common denominator with both a 50 hertz and 60 hertz system is preferable with the system of the invention.

In use, as the motor shaft rotates, the beam of light will intermittently be emitted through the slots or holes and similarly be interrupted when the holes are not aligned with the emitted beam. By counting the times in which the beam is interrupted, the controller "C" can use this information to determine the number of revolutions of the motor shaft. The number of revolutions of the motor shaft can then be used to determine the relative position of the shaft using the equations provided below. In this manner, the controller "C" can calculate the exact position (angle) of the shaft 205 and hence the positions of the sweep or rake assembly 200, e.g., gate 202, and the pin table 118.

By way of one example, the controller determines the gear ratio by detecting either a 50 hertz system or 60 hertz system by using an opto-coupler which senses zero-crossing from AC power, well known in the art. If the time between zero-crossing is greater than 18 ms, the system is considered a 50 Hz system. If the time between zero-crossing is less than 18 ms, the system is then considered a 60 Hz system. Once this is detected, the following calculation can be used based on a common denominator, e.g., the amount of holes within the disk, to determine the angle of the shaft between 0° and 360°.

In one exemplary illustration, in a 60 Hz operation, the motor revolution per drive shaft revolution is (X)=144. The motor position sensor counts per motor revolution is (Y)=15. The motor position sensor also counts per degree of drive shaft travel as (Z)=6. A calculation is made to determine drive shaft location in degrees=Z/6. In the 50 Hz operation, the motor revolution per drive shaft revolution is (X)=120. The motor position sensor counts per motor revolution as (Y)=15 and further counts per degree of drive shaft travel (Z)=5. Thus, drive shaft location in degrees=Z/5. If the motor position sensor sensed 360 pulses, the location of the drive shaft on 50 hz machine would be Z/5, or 360/5=72 degrees. Similarly, if the motor position sensor sensed 360 pulses, the location of the drive shaft on 60 hz machine would be Z/6, or 360/6=60 degrees. As thus described, by knowing the revolutions of the motor shaft, the controller "C" can control and determine the exact positions of the sweep or rake assembly 200, e.g., gate 202, and the pin table 118.

The stopping positions are set at initial setup and so the controller senses the frequency and accordingly calculates position of the output shaft using the motor shaft mounted position sensor as the basis. It also adjusts every cycle to ensure the initial set points are satisfied. Thus any wear in the mechanism will be compensated by the controller adjusting itself, accordingly.

Additionally and as briefly discussed above, the controller "C" can automatically make adjustments to the relative positioning of the sweep or rake assembly 200 and the pin table 118. This can be accomplished by knowing the shaft angle for each particular stage of the sweep or rake assembly 200 and the pin table 118, and then calculating the number of counts "M" required to obtain this angle. This can be calculated using the above equations, for example.

Bowling Ball/Safety Sensors

A first sensor 106 (or bowling ball sensor) detects the bowling ball preferably by a photodiode sensor that emits and detects a break in beams. The beams are used to make a determination of the speed of the bowling ball as well as provide a safety feature. The first sensor 106 detecting the bowling ball provides the gathered information from the break in the beams directly to the controller "C". In this manner, the controller "C" can detect, monitor and control the system 100 and related subassemblies.

By way of example, by having a known distance between two photodiode sensors within the first sensor 106 and knowing the equation of velocity (velocity (v)=distance (d)×time (t)), the controller can determine the velocity of the bowling ball. By knowing the velocity of the bowling ball, this information can then be used by the controller "C" to control the moment of initiating the lowering of the gate 202 into the down position, shown in FIG. 2. That is, the moment of initiation of movement of the gate 202 into the down position can be advanced or delayed depending on the ball speed. For example, when the ball is thrown faster than a threshold speed such as, for example, 18 mph the gate will be lowered sooner to thus ensure that the fallen pins will remain within the pin area 104 or fall onto the pit transport carpet 110.

The sensor 106 may also be used to protect the subassemblies of the system. In this exemplary embodiment, the breaking of the two beams will, again, be used by the controller "C" to lower the gate 202 into the position shown in FIG. 2. In this lowered position, the gate 202 will protect the subassemblies and more particularly the pin table 118 when in the lowered position to capture the remaining standing pins.

Additionally, the breaking sequence of the beams can also be used by the controller "C" for other functions, e.g., safety. For example, the controller "C" will only instruct the gate 202 to lower and sweep if the beams are broken in a predetermined sequence, e.g., in sequence, the closest beam to the foul line and then the farthest beam from the foul line. Thus, if the beams are not broken in the predetermined sequence, the controller will not instruct the gate 202 to lower and sweep and may, in embodiments, place the system in a sleep or safety mode. In another example, the controller "C" may monitor the beams during a pinspotter cycle such that should one or both of the beams be broken, i.e., inadvertently by a technician's foot or other body member during said cycle, the controller may place the system in a shut-down or safety mode to prevent injury.

By way of illustration, only one of the beams may have been broken due to a technician's foot tripping one of the beams during routine maintenance. This will ensure that during such maintenance the gate 202 or other subassemblies will not activate and injure the technician.

Braking System

Still referring to FIG. 6, a braking system 300 is used to brake the motors of the sweep or rake assembly 200 and the pin table 118. This braking system 300 is an electromagnetic braking system, such that the motor can be turned "off" prior to any braking. The braking system 300 is controlled by the controller "C".

In use, the electromechanical brake includes a friction pad, as should be well known in the art. The controller "C" will provide commands to the braking system to either release the brake to allow the rotor of the motor to spin freely or to apply force thereto to stop operations.

Now, with the monitoring of the components by the controller "C", including the rotation of the motor shaft (via the position sensor), the controller "C" can instruct the motor to shutdown. At this time, the motor will begin to coast, while the controller continues to monitor the position sensor for shaft position. As the revolutions per minute (RPM) of the motor begin to decrease, while monitoring the positions of the sweep or rake assembly 200 and the pin table 118, for example, the brake can begin to be applied and controlled. At a lower RPM, the brake will generate less friction, less heat and less energy, thus increasing the life of the brake. Also, the braking of the motors can also be more accurately controlled with the use of the position sensors.

Foul Line Sensor

The foul line sensor 108 is also directly communicating with the controller "C". The foul line sensor 108 is preferably a single photodiode sensor which can detect when a bowler has crossed the foul line. This detection occurs when the bowler breaks the beam. The breaking of the beam will then be relayed to the controller "C", which can then instruct a display (mask) to illuminate a foul signal such as, for example, a light, a sound alarm or indicia on an LCD display screen.

Controller

The controller "C" is directly connected and in communication with the subassemblies described above. For example, the controller "C" may be in direct communication with the home sensor 204 (FIG. 6A) and position sensor 206 (FIG. 6B), as well as the pinspotter mechanism (FIG. 6), e.g., sweep or rake assembly 200, pit transport carpet 110, pin elevator 112, pin bin 116, distributor 114 and pin table 118. In one aspect of the invention, the controller "C" is provided in a feedback loop with any combination of these systems (including all of these systems) in order to monitor, control and adjust these subsystems such as, for example, monitor and adjust the stopping positions of the pin table and sweep and rake assembly 200 within a pinspotter.

Figure 9:
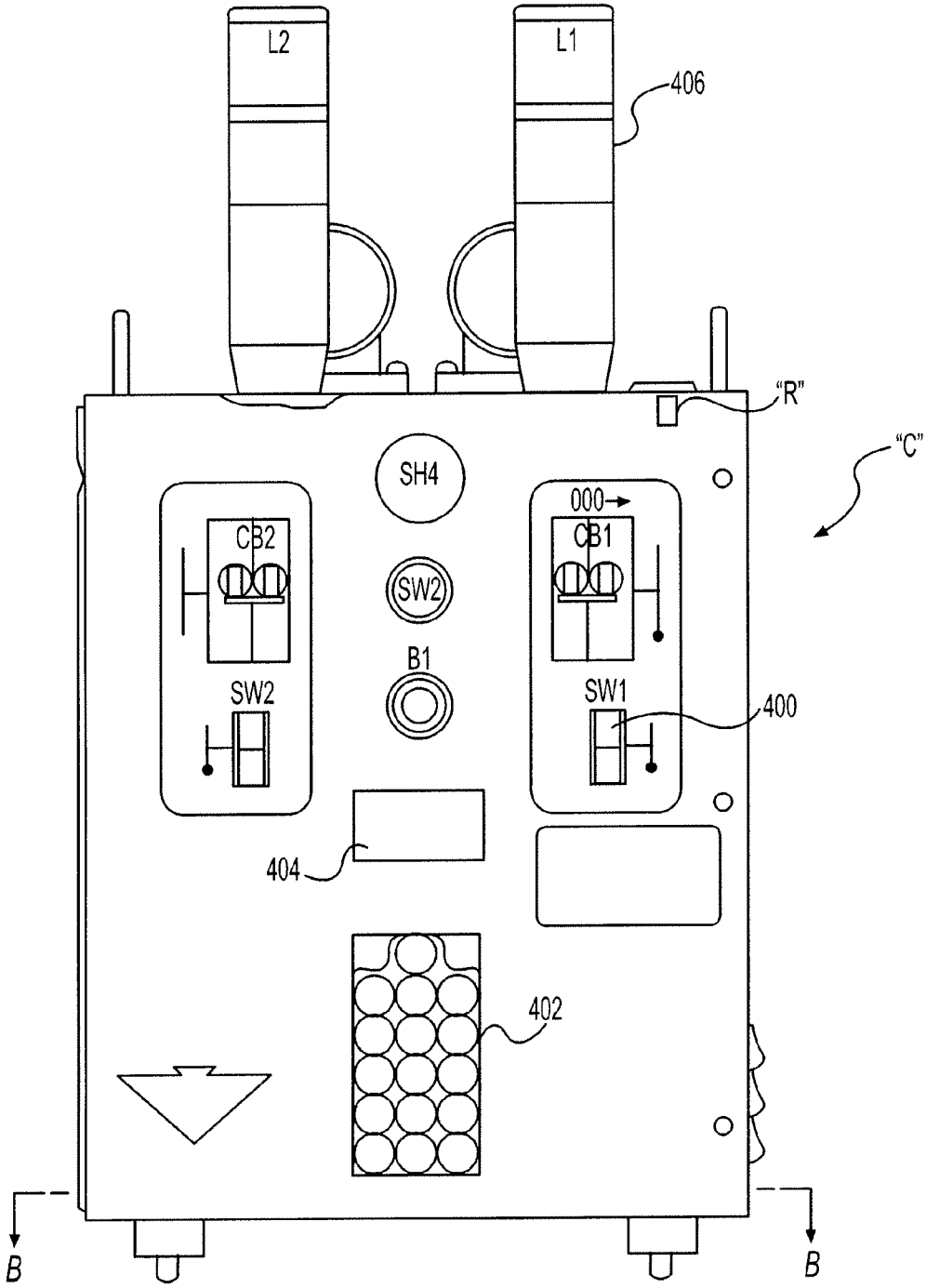
FIG. 9 shows the controller and accompanying features in accordance with an aspect of the invention.

FIG. 9 shows a controller panel in accordance with the invention. The controller "C" is typically used to control and monitor a pair of bowling lanes and its subassemblies. However, each controller "C" may control certain functions and provide certain diagnostics for any number of bowling lanes and its subassemblies. The controller, as should be well understood, includes logic, RAM, a processor and other known controller features.

The controller "C" includes shut-off switches 400 which shutdown the entire system. The controller "C" further includes a fully functional keypad 402, as well as an LCD display 404. The menu and control of the controller "C" may be used to set the stopping positions of the sweep or rake assembly of the pinspotter, for example, based on the relative positions of the shaft as recorded with use of the sensors.

The LCD display 404 can be used to show (i) the status of the subassemblies, (ii) the amount of pins remaining on the pin deck, (iii) the programmed functions, amongst other features. Some of this information may include, for example, the shaft angle associated with the position of the pin table 118 or the sweep or rake assembly 200, a foul detection, the amount of pins standing, the input power (50 Hz vs. 60 Hz), the operation mode, and the like. The controller "C" may also be used in combination with a relay "R" to determine a forward or reverse motion of the pinspotter subassemblies, etc.

The controller "C" is also in communication with a lighting system 406 (stack lights). In one embodiment, the lighting system may be used for diagnostics and includes two or more colors (in this embodiment only 2 are used), e.g., green and red. In use, the controller "C" will monitor the entire system through a plurality of switches and sensors and provide signals to the lighting system which can be used by the technician to monitor and diagnose the system. By way of illustration:

Solid green light: This may indicate that the system is in use and that there are no existing or sensed problems.

Flashing green light: This may indicated that the bin switch is open and thus there is not a full set of pins in the pin table. This may also be indicative of a pin jam. This usually occurs when a time period of 20 seconds is exceeded, without sensing the number 9 pin.

Solid red light: This may indicate a shutdown of the entire system due to a (i) position sensor 206 not providing feedback to the controller "C" once the motor it is attached to is instructed to operate by the controller, (ii) an unacceptable spike in electrical current in a motor, (iii) a technician tripping the ball sensor 200 during a pinspotter cycle, or (iv) an emergency situation.

Flashing red light: This may indicate a switch is open such as, for example, a mask (cover) switch.

In another implementation, the stack lights may be utilized in the following manner, according to the table below.

| Stack Light Warnings | |
|---|---|
| Green | Machine Turned on and ready to go. Bowl mode |
| Red | Machine in shut down mode. |
| Solid Red & Solid Green | Mechanics mode-mechanic is working on it |
| Flashing Green (with or without Solid Red) | Extended period of time for bin switch to See no pins(possible distributor jam) |
| Flashing Red | Mask switch is turned off. |
| Alternating from Green to Red | Mechanics call button pressed |
| No Lights | Standby |

The controller "C" can further be programmed or used to monitor many different pinspotter operations. As representative examples:

Standby Mode: On power up, the system is designed to go into standby mode for which the pin table and sweep or rake assemblies 200 are usually at the home position. In standby mode, there is no machine operation allowed.

Figure 17:
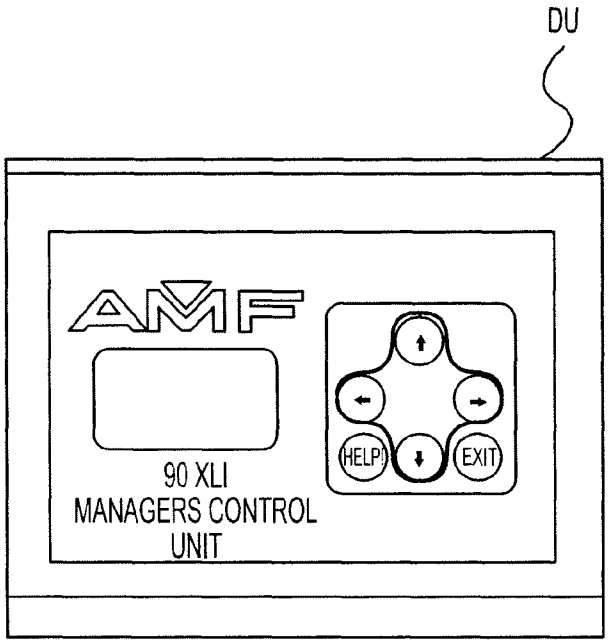
FIG. 17 shows a remote unit used with the invention.

Mechanic's Mode: In this mode, the system may run all cycles including scoring, pin pickup and sweep, for example. This mode also allows sweep/table up/down functions (incremental). The controller may also send signals to scoring. In this mode, there would be no predetermined delay when cycle button is pushed. In the mechanic's mode, the manager's control unit (MCU) (FIG. 17) and any functions sent through it by scoring are ignored to ensure safety of the mechanic (e.g., lockout mode of MCU).

Bowler's Mode: In this mode, the system operates according to all (e.g., six) cycles and may ignore sweep/table up/down buttons, cycle, and continuous cycle buttons. The cycle button may be active.

10th Frame Switch: In this scenario, the pinspotter responds by initiating and completing a cycle only when pin table and sweep or rake assembly 200 are at or near the home position.

Ball Detector: In this scenario, whenever the sweep or table motor are activated and the ball detector beam is broken, then the machine will turn off. Also it will start regardless of sweep or table being home, but will ignore ball detector if in the middle of a cycle. The pinspotter may be programmed to respond, e.g., if the sensors are tripped in order.

Sweep & Table Motor: In this scenario, after approximately ½ second of applied power to a motor, if the speed is below a threshold, e.g., 50 RPMs, the pinspotter will turn off the motors and the controller will illuminate the red warning light.

Bin and Shuttle: In this scenario, after the bin switch is deactivated (e.g., pins are released from bin), if 20 seconds are reached without seeing a new rack of pins (bin switch active), the green light will flash and the system will continue to stay in bowl or mechanic's mode.

Table & Sweep Stopping Positions: During the operation of sweep/table, during the bowler's mode and cycling in mechanic's mode, the controller will self-adjust stopping positions. This can be performed by use of the relative positions of the home sensor with that of the position sensor. For example, if the controller determines that the position of FIG. 2 should be at, for example, a shaft angle of 175°, the controller can automatically adjust such angle via control.

Electro-Mechanical Braking for Sweep and Table: In bowler's mode, during machine cycling, the electromechanical brake will engage when the sweep or table motor speed drops below a threshold, for example, 60 RPM. When the table or sweep up/down buttons are pressed in mechanic's mode, the brake will engage when the sweep/table buttons (up or down) are released and the motor speed drops below the threshold. In an alternative embodiment, when up/down is used, the brake is applied immediately upon button release. The brake may be disengaged first, and after a predetermined time, e.g., 200 mS later, the motor will engage. When the motor turns off, the brake may be applied ½ second after the motor has been turned off.

Additionally, the following table is also representative of menus that are displayed on the controller "C", and which can be used to automate and/or program the features of the invention. Of course other functions may also be provided, of which the following is only one exemplary illustration.

Settings Menu

| Chassis Mode | Bowl | Standby | Practice Pins | Practice Non-Pins | | | Comments |
|---|---|---|---|---|---|---|---|
| Auto Backend Shutoff | ON | OFF | | | | | Machine shuts off after x seconds of inactivity on balls thrown |
| Auto Cycle Frame 10, Ball 2 | ON | OFF | | | | | After $10^{th}$ frame, ball 2, the machine will cycle automatically to $1^{st}$ ball for new game. |
| Auto Offspot Cycle | ON | OFF | | | | | If pin moves out of the range of the pinspotter pin grabber fingers, A switch is actuated and based on the setting could work differently. |
| Bumpers | UP | DOWN | AUTO | | | | Sets the mode of gutter bumpers |
| Foul Detector | ON | OFF | Warning | | | | Sets the type of foul detection and warning required |
| Foul Sweep Reverse | ON | OFF | | | | | Sets the function to be performed on foul detection scoring systems. |
| Pin Data | Camera | Scoring | | | | | Sets the setting of upfront scoring type, AMF or other |
| Pin Data Delay | 0 | 0.75 | 1.25 | 1.75 | 2.25 | 2.75 | Sets the time delay for the camera to start scoring the fallen pins |
| Pin Light | White | Black | | | | | Sets the pitlight in the machine to either color |
| Start Signal Delay | Auto | 0–3 seconds | | | | | Sets the time delay for the machine to let the sweep/guard down when a ball is detected |
| Sweep Reverse | ON | OFF | | | | | Sets the sweep to be able to reverse automatically based on the type of ball scored |

| Functions Menu | |
|---|---|
| Clear Offspot | When offspot setting set to stop and wait for service, this function will let the operator at the desk or the mechanic at the back respond by completing the offspot cycle. |
| Clear Pindeck | To clear a single machine pindeck of all pins or do the same for multiple lanes |
| Cycle Lane | To cycle a particular lane or lanes and move to the next ball. |
| Frame Count | To obtain total frames bowled to help obtain lane usage/lineage( mechanics ball count, mechanics frame count, bowl ball count, bowl frame count) |
| Reset Count | To reset the frame counts (mechanics ball count, mechanics frame count, bowl ball count, bowl frame count) |
| Set 10 pins | Sets 10 new pins |
| | Home |
| Reset to Factory Settings | To reset to all default factory settings |

In addition, a diagnostics menu of the controller "C" may be used to show the status of all sensors, switches, and electronic components controlled or used by the controller "C". Of course other diagnostic functions may also be provided, of which the following is only one exemplary illustration. As a representative sample:

| Diagnostics Menu | | | | |
|---|---|---|---|---|
| Backend Motor | On | Off | Over-load | Sleep |
| Backend Switch | On | Off | | |
| Ball Detector 1 | Ball | No Ball | | |
| Ball Detector 2 | Ball | No Ball | | |
| Ball Lift | On | Off | | |
| Bin Jam Switch | Jammed | Not Jammed | | |
| Bin Switch | Pin Present | Pin Absent | | |
| Breaker | On | Off | | |
| Foul Detector | Foul | No Foul | | |
| E-Stop Loop | Open | Closed | | |
| Mask Switch | On | Off | | |
| Offspot Switch | On | Off | | |
| Pinspotter State | Bowl | Mechanic | Stand-by | Continuous Cycle (Errors) |
| Scoring Data | *Graphics | | | |
| Sweep Encoder | 0–360 degrees | | | |
| Sweep Home | Home | Not Home | | |
| Table Encoder | 0–360 degrees | | | |
| Table Home | Home | Not Home | | |
| Tenth Frame | On | Off | | |

Also, the following table shows warning errors and shutdown errors which may result, for example, when a motor exceeds a threshold amperage. This will ensure that the motor, such as the pin elevator motor, does not burn out due to a pin jam. Of course other errors, messages, etc. may also be provided, of which the following is only one exemplary illustration.

| Shutdown Errors | |
|---|---|
| Breaker | Circuit breaker is turned off |
| Sweep Encoder | Sweep jam or encoder sensor error |
| Table Encoder | Table jam or encoder sensor error |
| Bin Jam | Bin jam error |
| Ball Detector | Ball Detector beam is broken during sweep or table motor operation |
| Mask Switch | Mask Switch is turned off |
| Offspot | Offspot switch is activated and waiting for Clear Offspot command. |
| Table Home | Home switch not found after 3 revolutions of drive shaft, or home is detected continuously, not allowing the encoder counter to count and remain at zero degrees. |
| Sweep Home | Home switch not found after 3 revolutions of drive shaft or home is detected continuously, not allowing the encoder counter to count and remain at zero degrees. |
| Overload | Backend Motor has jammed or overloaded |
| E-Stop | E-stop circuit is opened |
| Interlock | Table and Sweep are interlocked |

| Warning Errors | |
|---|---|
| $1^{st}$ guard adj | Sweep adjusted out of range for $1^{st}$ guard |
| $2^{nd}$ guad adj | Sweep adjusted out of range for $2^{nd}$ guard |
| Sweep hm adj | Sweep adjusted out of range for home stop position |
| Sweep rev adj | Sweep adjusted out of range for sweep reverse home stop position |
| Table B1 adj | Table adjust out of range for ball 1 home stop position |
| Table B2 adj | Table adjust out of range for ball 2 home stop position |

Remote Units

Figure 16:
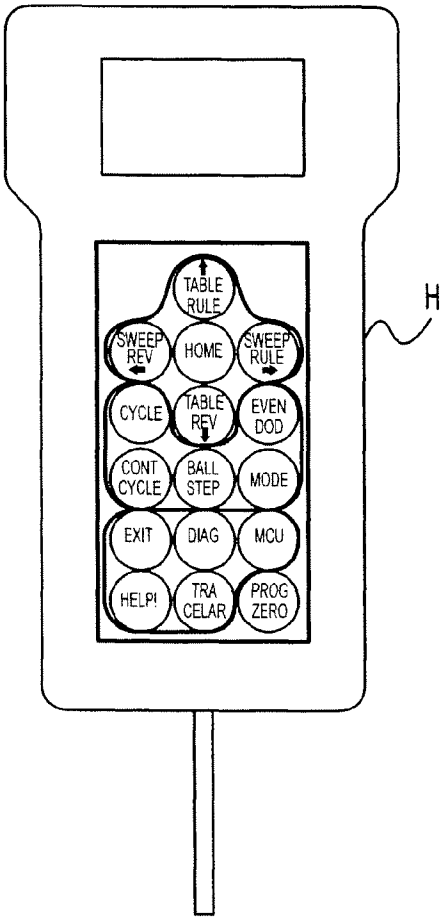
FIG. 16 shows a handheld unit used with the invention.

In any of the above modes or other cycles, the controller "C" may be used to monitor two or more bowling lanes. Additionally, the controller "C" may be in communication with a handheld unit "H" (FIG. 16), via RF or other known physical communication link. The handheld unit may be used to provide all of the features and functions of the controller "C" and would thus include logic, RAM, a processor amongst other features known in the art for remote control and monitoring. The following table shows the functions, in one embodiment, provided by the handheld unit. Of course other functions may also be provided, of which the following is only one exemplary illustration.

| Settings Menu | | | | | | |
|---|---|---|---|---|---|---|
| Chassis Mode | Bowl | Standby | Practice Pins | Practice No-Pins | | |
| Auto Backend Shutoff | On | Off | | | | |
| Auto Cycle Ball 2, Frame 10 | On | Off | | | | |
| Auto Offspot Cycle | On | Off | | | | |
| Bumpers | Up | Down | Auto | | | |
| Foul Detector | On | Off | Warning | | | |
| Foul Sweep Reverse | On | Off | | | | |
| Guard Set Menu | $1^{st}$ guard | $2^{nd}$ guard | | | | |
| Lane ID | 1–128 | | | | | |
| Pin Data | Camera | Scoring | | | | |
| Pin Data Delay | 0 | 0.75 | 1.25 | 1.75 | 2.25 | 2.75 |
| Pit Light | White | Black | | | | |
| Start Signal Delay | Auto | 0–3 seconds | | | | |
| Sweep Reverse | On | Off | | | | |

Functions Menu

The functions menu of the handheld unit may include, for example, the following functions:

Clear Offspot
Clear Pindeck
Cycle Lane
Frame Count
Reset Bowl Frame Count
Reset Mechanic Frame Count
Scoring Data
Home
Reset to Factory Settings
Set New Pins These above functions will be well understood by those of skill in the art.

The controller may also be in communication with a remote desk unit "DU" (FIG. 17), which provides limited access to functions, including for example reset options. Both the handheld unit and the remote unit thus provide remote displays to show real time graphical/text status of any pinspotter or pair of pinspotters in a bowling center.

Exemplary Methods of Use

Figure 10:
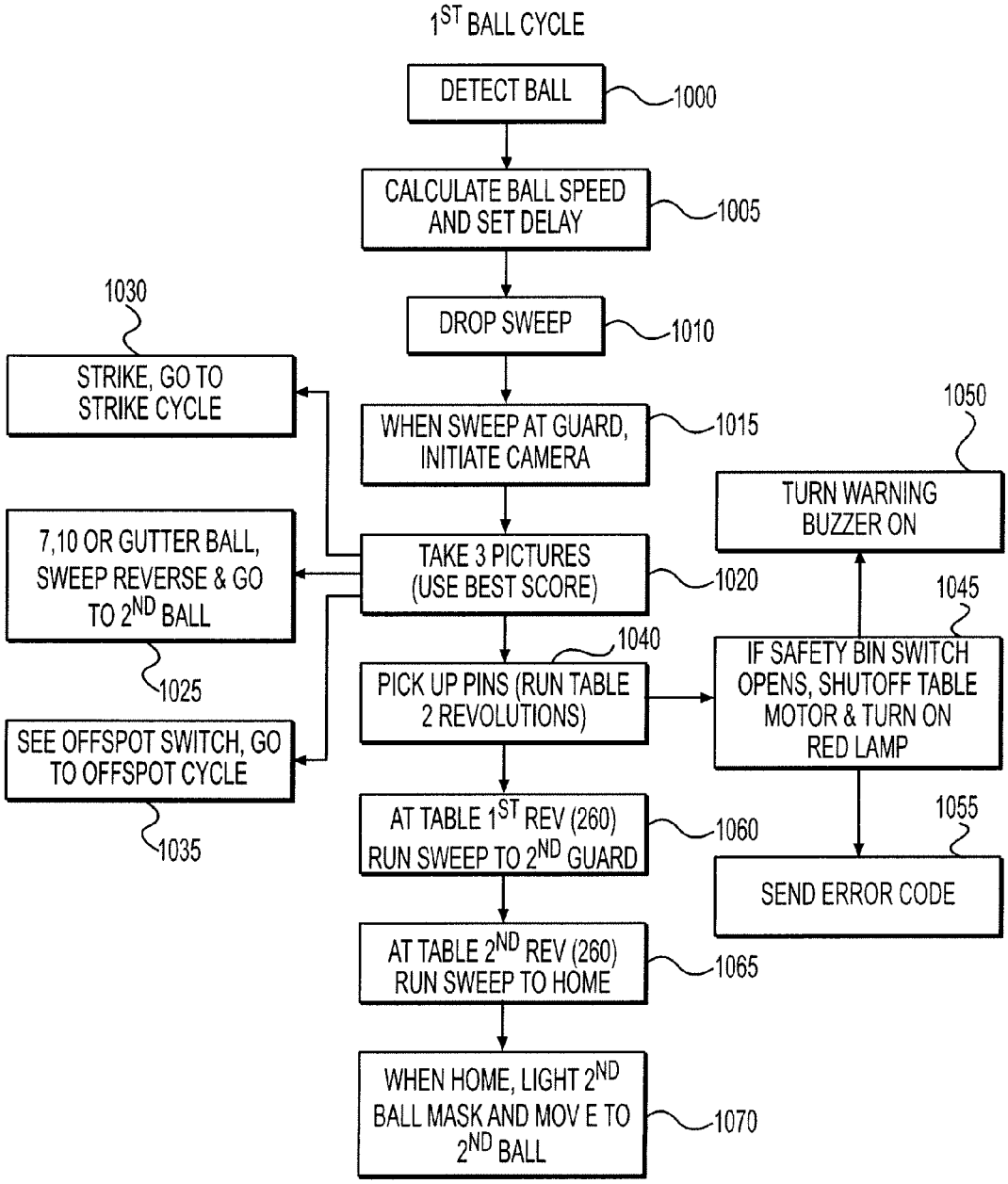
FIG. 10 is a flow diagram showing steps implementing a method of the invention.

FIG. 10 is a flow diagram showing steps implementing a method of the invention. The steps of FIG. 10 and FIGS. 11-15 may be implemented on computer program code in combination with the appropriate hardware. These steps are controlled by the controller "C". This computer program code may be stored on storage media such as a diskette, hard disk, CD-ROM, DVD-ROM or tape, as well as a memory storage device or collection of memory storage devices such as read-only memory (ROM) or random access memory (RAM). The flow diagrams may equally represent a high level block diagram of the system of the present invention, implementing the steps thereof.

At step 1000, a ball is detected. At step 1005, the ball speed is calculated and a set delay in the gate is provided by the controller. At step 1010, the gate or sweep is dropped to the first guard position. At step 1015, the camera mode is initiated and, at step 1020, a plurality of pictures is taken. In one implementation, three pictures may be taken and a best score is given to the controller "C", via communication with the camera.

At step 1025, a determination is made as to whether a 7, 10 or gutter ball or strike was provided. If a (7, 10 or gutter) is bowled, then the gate is reversed and the system proceeds to FIG. 12. If there was a strike, then the system proceeds to FIG. 14. If not, then at step 1035, a determination is made as to whether the offspot switch is activated. If so, the system proceeds to FIG. 15. It should be understood that the steps of 1025-1035 may be provided in any order and that the process sequence is not limited to that disclosed herein.

At step 1040, the pin table will pick up all standing pins. At step 1045, a determination is made as to whether the safety switch for the pin table is activated. (If the safety bin switch is activated at any time, it will go into shutdown mode.) If so, then a warning buzzer or error code can be transmitted to the technician, at steps 1050 or 1055, respectively. At step 1060, the pin table will proceed to pick up standing pins while the sweep clears the pin deck of fallen pins, i.e. deadwood, and then runs to the $2^{nd}$ guard position. At step 1065, the pin table will proceed to replace the standing pins back onto the pin deck and then begin its motion back to the home position. At a predetermined position of the pin table shaft, e.g. 260°, the sweep will begin its motion to the home position, thus allowing the sweep and pin table to return to their respective home positions at approximately the same time.

When the pin table is in the home position, the system will proceed to the $2^{nd}$ ball mode at step 1070 and discussed with reference to FIG. 12.

Figure 11:
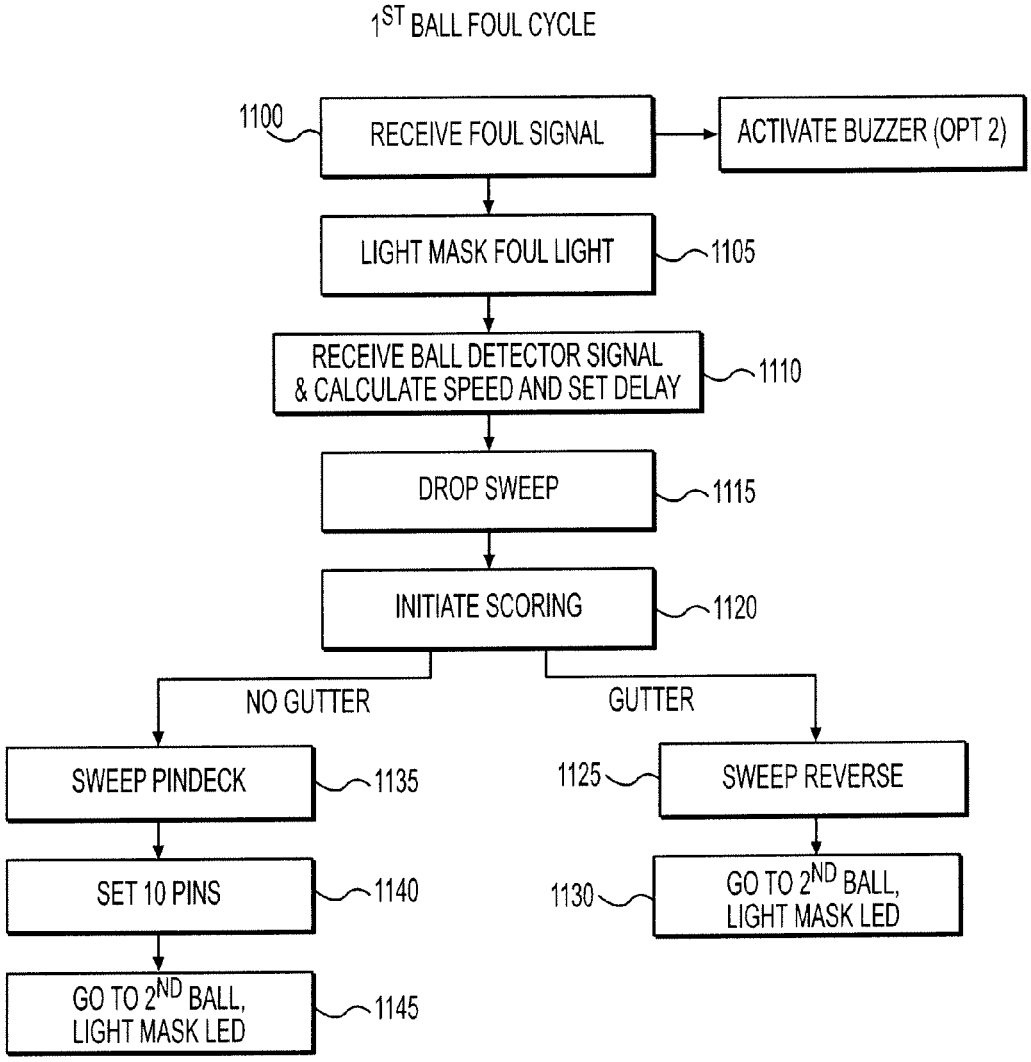
FIG. 11 is a flow diagram showing steps implementing a method of the invention.

FIG. 11 shows the steps implementing a first ball foul cycle. In this mode, the controller will receive a foul signal from the foul sensor at step 1100. At step 1105, a mask foul light or other indicia will notify the bowler of a foul. At step 1110, the system will receive the ball detector signal from the sensor 106, which will be used to calculate the speed of the ball and the delay of the gate into the position of FIG. 2. At step 1115, the gate will sweep and, at step 1120, an initial scoring will be provided (via the camera and controller system).

If there is a gutter ball, at step 1125, the sweep direction will be reversed to bring it back to the home position. At step 1130, the system will proceed to the $2^{nd}$ ball cycle described with reference to FIG. 12. If there is no gutter ball, then the gate will sweep the pin deck at step 1135 and the pin table will set the next ten (10) pins at step 1140. At step 1145, the system will proceed to the $2^{nd}$ ball cycle described with reference to FIG. 12.

Figure 12:
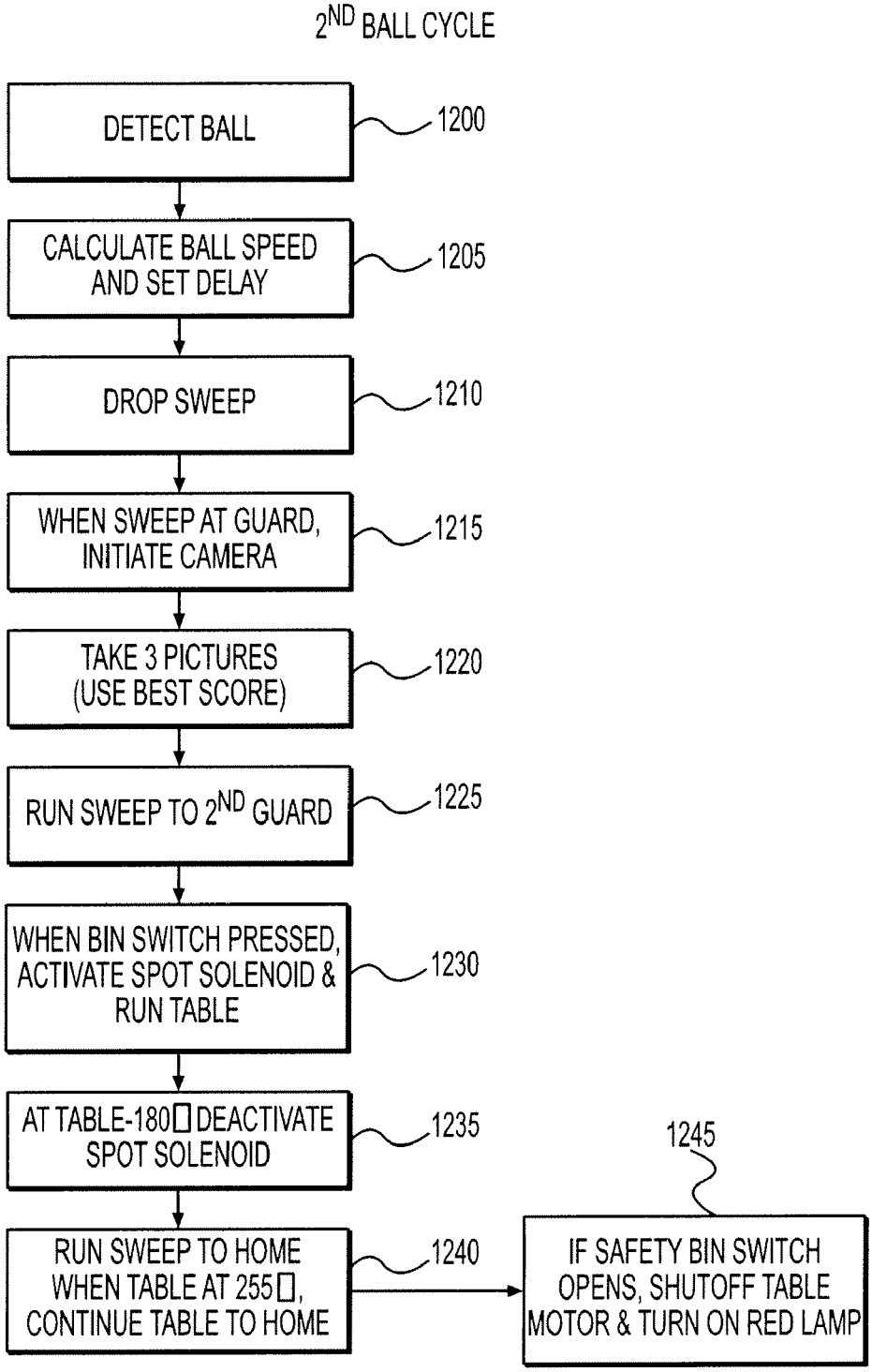
FIG. 12 is a flow diagram showing steps implementing a method of the invention.

FIG. 12 shows the steps implementing the $2^{nd}$ ball cycle. In this mode, at step 1200, a ball is detected. At step 1205, the ball speed is calculated and a set delay in the gate is provided by the controller. At step 1210, the gate or sweep is dropped to the pin deck. At step 1215, the camera mode is initiated and, at step 1220, a plurality of pictures is taken. In one implementation, three pictures may be taken and a best score is calculated by the camera and scoring system. This score is given to the controller "C" via communication with the camera.

At step 1225, the gate will provide a sweep of the pin deck. The bin switch is then pressed by a pin in the #9 bin location in order to activate the pin table, at step 1230. The spot solenoid is simultaneously activated to release pins from the bin into the pin table at step 1230. If the bin switch remains open at step 1230, the green light will flash and the cycle will continue after the bin switch is detected. At step 1235, the spot solenoid is deactivated (e.g., shaft angle of approximately 260). The gate and pin table then return to home at step 1240.

Figure 13:
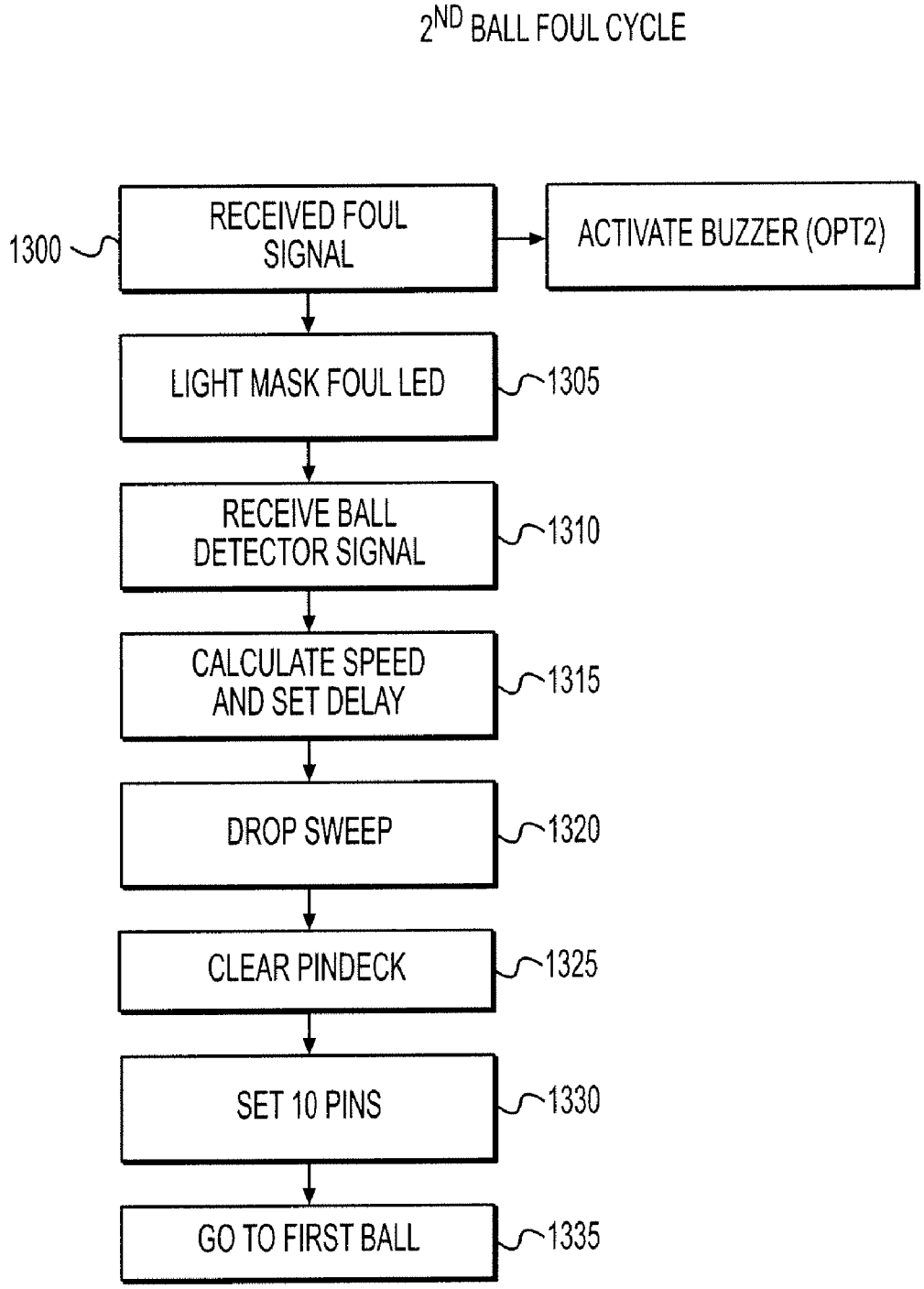
FIG. 13 is a flow diagram showing steps implementing a method of the invention.

FIG. 13 shows the steps implementing the $2^{nd}$ ball foul cycle. In this mode, the controller will receive the foul signal at step 1300. At step 1305, an LED or other indicia may be provided to inform the bowler of a foul. At step 1310, a ball is detected. At step 1315, the ball speed is calculated and a set delay in the gate is provided by the controller. At step 1320, the gate or sweep is dropped to the pin deck. At step 1325, the pin deck is cleared and, at step 1330, the pin table provides a new set of ten (10) pins on the pin deck. At step 1335, the system returns to the cycle shown in FIG. 10.

Figure 14:
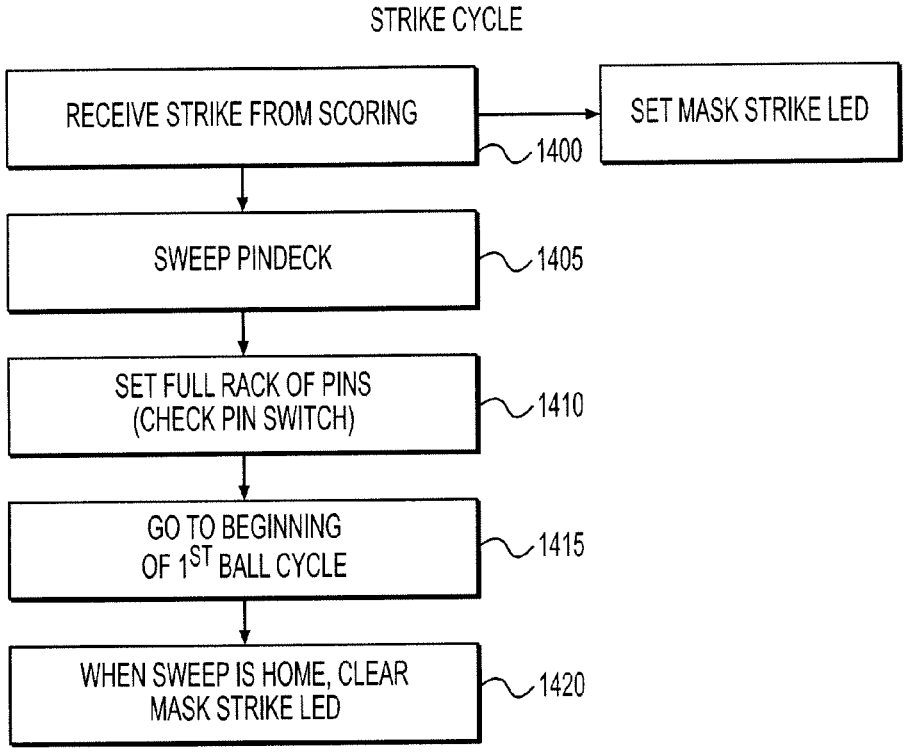
FIG. 14 is a flow diagram showing steps implementing a method of the invention.

FIG. 14 shows the steps implementing a strike cycle. In this mode, the controller receives a signal at step 1400 from the camera that all ten (10) pins have been knocked down. At step 1405, the pin deck is swept by the gate. At step 1410, a full rack of ten (10) pins is placed on the pin deck by the pin table. At step 1415, the system returns to the cycle of FIG. 10. At step 1420, when the gate is in the home position, the $2^{nd}$ ball mask LED is cleared.

Figure 15:
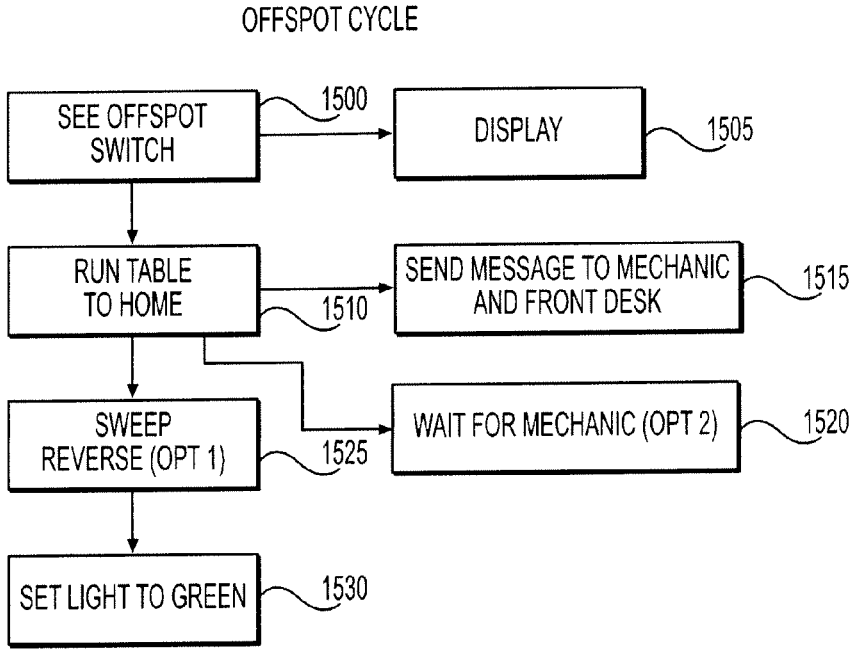
FIG. 15 is a flow diagram showing steps implementing a method of the invention.

FIG. 15 shows the steps of implementing an offspot cycle. At step 1500, an offspot switch is activated, and at step 1505, an offspot message will appear on the pinspotter control display. At step 1510, the pin table is run to its home position and, at step 1515, a message is sent to the technician via the controller to either a handheld unit or a unit at a predetermined location (e.g., front desk). The system may then be placed in a mechanic's or bowl mode at step 1520, waiting for clear offspot command before continuing. At step 1525, the sweep direction is reversed and at step 1530, the green light will remain illuminated.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

It is claimed:

1. A bowling system comprising:

a pinspotter system including at least a sweep assembly and a braking system coupled thereto which provides a brake for said sweep assembly;

a plurality of sensors which sense parameters associated with said pinspotter system and said braking system, wherein said plurality of sensors include a non-contact home position sensor for said sweep assembly; and a centralized control system centralizing operational processes of said pinspotter system by receiving at least one input based on the sensed parameters from at least one of said plurality of sensors and, in response to at least one said input, produces at least one output signal to control operations of said pinspotter system.

2. A bowling system according to claim 1, wherein said braking system is a electromagnetic braking system.

3. A bowling system according to claim 2, wherein said electromagnetic braking system is under command of said centralized control system, such that said centralized control system commands said electromagnetic braking system to either release the brake to allow a motor to spin freely or to apply a braking force thereto after a rotational speed of a motor shaft of a motor begins to decrease.

4. A bowling system according to claim 1, wherein said plurality of sensors includes a speed/safety sensor arranged proximate said sweep assembly to detect a speed of a ball or a sequence of events.

5. A bowling system according to claim 4, wherein said speed/safety sensor includes at least two photodiode sensors arranged at a distance from one another.

6. A bowling system according to claim 1, wherein said plurality of sensors includes a foul line sensor to detect a foul line violation, and provides an input signal to said centralized control system to signal at least said foul line violation.

7. A bowling system according to claim 6, wherein said signal of a foul line violation comprises at least a light, an audio device and an LCD display of which is actuated by said centralized control system in response to said foul line violation.

8. A bowling system according to claim 1, wherein said centralized control system monitors a foul line system malfunction and a foul line system check.

9. A bowling system according to claim 1, wherein said plurality of sensors are non-contact sensors.

10. A bowling system according to claim 1, wherein said centralized control system adjusts a position of said sweep assembly during operational stages of said sweep assembly.

11. A bowling system according to claim 1, wherein said centralized control system monitors, controls and provides diagnostics for more than one bowling lane.

12. A bowling system according to claim 1, further comprising one or more hand held units or remote units coupled to said centralized control system which monitors, controls and provides diagnostics for more than one bowling lane.

13. A bowling system according to claim 1, wherein said centralized control system monitors, controls and provides diagnostics for said pinspotter operations which include at least one of a standby mode, a mechanic's mode, a bowler's mode, a tenth frame switch mode, a hall detection mode, a sweep and table motor mode, a bin and shuttle mode, a table and sweep stopping position mode, and an electromechanical braking for sweep and table mode.

14. A bowling system according to claim 1, wherein said centralized control system provides a menu for operations of said sweep assembly.

15. A bowling system according to claim 1, wherein said centralized control system is in communication with at least one of a keypad and an LCD display.

16. A bowling system according to claim 15, wherein said LCD displays at least one of operational monitoring, control, programming, and diagnostics of the bowling system.

17. A bowling system according to claim 1, wherein said centralized control system monitors the bowling system through a plurality of switches and said plurality of sensors providing signals to a lighting system for monitoring and diagnostics.

18. A bowling system according to claim 1, wherein the bowling system comprises one or more bowling lanes.

19. A bowling system according to claim 1, wherein said home position sensor for said sweep assembly comprises a home position sensor of a shaft of said sweep assembly.

20. A bowling system according to claim 1, further comprising a position sensor for said sweep assembly, wherein said centralized control system is coupled to said home sensor and said position sensor, the centralized control system storing a home position of the sweep assembly as a reference and, based on said reference, a number of interruptions sensed by the position sensor enables said centralized control system to calculate a position of said sweep assembly.

21. A bowling system according to claim 1, wherein the non-contact home position sensor comprises a disk having a slot mounted to a shaft and a light emitting device comprising an emitter and detector or reflector adjacent opposing sides of the disk.

22. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein at least one sensor of the plurality of sensors monitors a rotational speed of a sweep motor shaft of said sweep assembly and provides an input signal to said centralized control system indicative of said rotational speed, such that a braking action, under command of said centralized control system, applies a sweep motor braking force after said rotational speed of said sweep motor shaft begins to decrease.

23. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein the pinspotter system includes a pin table assembly and said plurality of sensors includes at least one sensor which monitors a rotational speed of a pin table motor shaft of said pin table assembly and provides an input signal to said centralized control system indicative of said rotational speed, such that a braking action, under command of said centralized control system, applies a pin table motor braking force after said rotational speed of said pin table motor shaft begins to decrease.

24. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

a speed/safety sensor including at least two photodiode sensors arranged at a distance from one another;

wherein said centralized control system receives an input from said at least two photodiode sensors such that said centralized control system calculates a speed of the ball, and at a predetermined speed of the ball actuates said sweep assembly, wherein a position of the sweep assembly is determined by a positioning of a non-contact position sensor.

25. A bowling system according to claim 24, wherein the non-contact position sensor includes a photodiode and a disk having a slot mounted on a sweep assembly shaft such that an alignment of said slot with an emitted beam represents an angled position of the sweep assembly shaft or a home position of said sweep assembly.

26. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system; and said plurality of sensors including a speed/safety sensor arranged proximate said sweep assembly to detect a speed of a ball or a sequence of events, wherein said centralized control system activates or deactivates said sweep assembly based on a predetermined sequence of events as sensed by said speed/safety sensor.

27. A bowling system according to claim 26, wherein said plurality of sensors includes a non-contact home position sensor comprising a photodiode and a disk having a slot mounted on a sweep assembly shaft such that an alignment of said slot with an emitted beam represents an angled position of the sweep assembly shaft or a home position of said sweep assembly.

28. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said plurality of sensors includes a home sensor comprising a photodiode and a disk having a slot mounted on a sweep assembly shaft such that an alignment of said slot with a beam emitted from the home sensor represents an angled position of a sweep assembly shaft or a home position of said sweep assembly.

29. A bowling system according to claim 28, wherein said home position of said sweep assembly is used as a starting reference for said centralized control system to instruct movement or adjust a position of said sweep assembly.

30. A bowling system according to claim 29, wherein said centralized control system stores said home position as a reference, and based on said reference, said centralized control system adjusts a position of said sweep assembly to the home position when misalignment is sensed by said home sensor.

31. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said plurality of sensors includes a home sensor comprising a photodiode and a disk having a slot mounted on a pin table shaft and an alignment of said slot with a beam emitted from said home sensor represents an angled position of a pin table shaft or a home position of a pin table.

32. A bowling system according to claim 31, wherein said centralized control system stores said home position as a reference, and based on said reference, said centralized control system adjusts a position of said pin table to the home position when misalignment is sensed by said home sensor.

33. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said plurality of sensors includes:

a position sensor comprising:

a position disk having a plurality of slots or holes located about a circumference of said position disk, said position disk mounted to a motor shaft of a pin table assembly or said sweep assembly; and a photodiode sensor sensing interruptions in the plurality of slots or holes as said motor shaft rotates;

a home sensor comprising:

a home disk having a single slot or hole, said home disk being mounted on a shaft of said pin table assembly or said sweep assembly; and a home photodiode sensing an interruption of said slot or hole on said home disk as said shaft rotates;

wherein said centralized control system calculates a position of said motor shaft based on the number of revolutions of said motor shaft and an initial reference as sensed by said home sensor.

34. A bowling system according to claim 33, wherein the home position is determined by the alignment of said slot or hole on said home disk and a beam of light emitted by the home sensor.

35. A bowling system according to claim 33, wherein the slots or holes of the disk are configured for a 50 Hertz or 60 Hertz system.

36. A bowling system, comprising:

a pinspotter system including at least a sweep assembly and a braking system coupled thereto which provides a brake for said sweep assembly;

a plurality of sensors which sense parameters associated with said pinspotter system and said braking system, the plurality of sensors including a home sensor comprising:

a disk having a slot mounted to a shaft; and a light emitting device comprising an emitter and detector or reflector adjacent opposing sides of the disk; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said centralized control system includes a feed back loop for monitoring and controlling said pinspotter system and said plurality of sensors.

37. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said lighting system displays a first color indicating the bowling system is ready for operation and no existing or sensed problems exist;

wherein said lighting system displays a flashing color indicating at least one bin switch is open or not a full set of said pins are in a pin table and indicative of a pin jam;

wherein said lighting system displays a second color indicating a shutdown of the entire bowling system; and wherein said second color is displayed when at least one of said position sensor is not providing feedback after receiving a command from said centralized control system, an unacceptable spike in electrical current during operation of the bowling system is sensed and said plurality of sensors not sensing a predetermined sequence of events.

38. A bowling system, comprising:

a pinspotter system including at least a sweep assembly and a braking system coupled thereto which provides a brake for said sweep assembly;

a plurality of sensors which sense parameters associated with said pinspotter system and said braking system; and a centralized control system centralizing operational processes of said pinspotter system by receiving at least one input based on the sensed parameters from at least one of said plurality of sensors and, in response to at least one said input, produces at least one output signal to control operations of said pinspotter system;

wherein said sweep assembly includes a gate, such that said gate triggers a camera capturing an amount of standing pins and communicates said amount of standing pins to said centralized control system so as to determine at least one of a score, and whether said sweep assembly needs to be activated due to a gutter ball.

39. A bowling system comprising:

a pinspotter system including at least a sweep assembly and a braking system coupled thereto which provides a brake for said sweep assembly;

a plurality of sensors which sense parameters associated with said pinspotter system and said braking system;

said plurality of sensors including a speed/safety sensor arranged proximate said sweep assembly to detect speed of a ball; and a centralized control system centralizing operational processes of said pinspotter system by receiving at least one input based on the sensed parameters from at least one of said plurality of sensors and, in response to at least one said input, produces at least one output signal to control operations of said pinspotter system, wherein at least one sensor of the plurality of sensors monitors a rotational speed of a sweep motor shaft of said sweep assembly and provides an input signal to said centralized control system indicative of said rotational speed, such that a braking action, under command of said centralized control system, applies a sweep motor braking force after said rotational speed of said sweep motor shaft begins to decrease.

* * * * *

UNITED STATES PATENT AND TRADEMARK OFFICE

CERTIFICATE OF CORRECTION

PATENT NO. : 8,192,292 B2
APPLICATION NO. : 11/159273
DATED : June 5, 2012
INVENTOR(S) : Matthew E. Popielarz It is certified that error appears in the above-identified patent and that said Letters Patent is hereby corrected as shown below:

On the Title Page:
Item (73) under "Assignee": Quibicamp Worldwide LLC (Mechanicsville, VA) is changed to QubicaAmf Worldwide LLC (Mechanicsville, VA).

Signed and Sealed this
Seventeenth Day of July, 2012

David J. Kappos

David J. Kappos
*Director of the United States Patent and Trademark Office*